United States Patent [19]

Beard et al.

[11] Patent Number: 4,949,785

[45] Date of Patent: Aug. 21, 1990

[54] FORCE-LIMITING/WEAR COMPENSATING ANNULAR SEALING ELEMENT FOR BLOWOUT PREVENTERS

[76] Inventors: Joseph O. Beard, 1025 N. Lincoln Ave., Fullerton, Calif. 92631; Stanley W. Granger, 23800 Gold Nugget, Diamond Bar, Calif. 91765; Frode Sveen, 12697 Orgren Ave., Chino, Calif. 91710

[21] Appl. No.: 346,415

[22] Filed: May 2, 1989

[51] Int. Cl.[5] ..... E21B 33/06

[52] U.S. Cl. ..... 166/84; 166/196; 277/235 R; 251/1.2

[58] Field of Search ..... 166/84, 82, 196; 277/166, 178, 188 A, 235 R; 251/1.1, 1.2

[56] References Cited

U.S. PATENT DOCUMENTS

| | | | |
|---|---|---|---|
| 3,323,773 | 6/1967 | Walker | 166/82 |
| 3,561,723 | 2/1971 | Cugini | 251/1.2 |
| 3,667,721 | 6/1972 | Vujasinovic | 251/1.1 |
| 4,602,794 | 7/1986 | Schaeper et al. | 251/1.2 |
| 4,605,195 | 8/1986 | Burton et al. | 251/1.2 |

FOREIGN PATENT DOCUMENTS

| | | | |
|---|---|---|---|
| 1384723 | 3/1988 | U.S.S.R. | 166/84 |

*Primary Examiner*—Thuy M. Bui

*Assistant Examiner*—Terry Lee Melius

*Attorney, Agent, or Firm*—William L. Chapin

[57] ABSTRACT

An improved annular sealing element for oil well blowout preventers includes a plurality of curved metal segments spaced apart at regular circumferential angles and imbedded in a resilient matrix forming a generally lenticular-shaped body with a hollow central bore. Each segment has a tooth-like upper plate section which has a convex upper, outer surface adapted to slide upwards on the concavely curved inner wall surface of a blowout preventer cavity. Each upper tooth-like plate section has a downwardly depending web which is vertically pivotably supported within a groove formed in the upper surface of a wedge-shaped base plate at the bottom of the lenticular body. The inner toe portion of each base plate is imbedded in the resilient matrix, while the rear, heel portion of each base plate, which has a convexly curved lower surface, protrudes through the matrix. Pivotability of the upper portion of each segment relative to the base plate limits the force exertable by the element on a drill string component. Upward pivotal motion of the heel portion of the base plate feeds resilient material upwards and radially inwards to compensate for wear of resilient material in the vicinity of the bore walls.

13 Claims, 4 Drawing Sheets

FORCE-LIMITING/WEAR COMPENSATING ANNULAR SEALING ELEMENT FOR BLOWOUT PREVENTERS

BACKGROUND OF THE INVENTION

A. Field of the Invention

The present invention relates to apparatus for use in the drilling and operation of sub-surface wells, particularly oil wells and geothermal wells. More particularly, the invention relates to an improved annular sealing element for use in blowout preventers of the type used to prevent pressurized subterranean liquids or gases from blowing out and upwards through a well hole.

B. Discussion of Background Art

In drilling for natural gas or liquid petroleum, a drill string consisting of many lengths of threaded pipes screwed together and terminated by a drill bit head is used to bore through rock and soil. The drill bit head has a larger diameter than the pipes forming the drill string above it. The upper end of the drill string is rotated to transmit a rotary boring action to the drill bit head.

During the drilling operation, a specially formulated mud is introduced into an opening in an upper drill pipe. This mud, which typically is selected to have a high specific gravity, flows downwards through the hollow interior of the pipes in the drill string and out through small holes or jets in the drill bit head. Since the drill bit head has a larger diameter than the drill string above it, an elongated annular space is created during the drilling process which permits the mud to flow upwards to the surface. Mud flowing upwards carries drill cuttings, primarily rock chips, to the surface. The mud also lubricates the rotating drill string, and provides a downward hydrostatic pressure which counteracts pressure which might be encountered in subsurface gas pockets.

In normal oil well drilling operations, it is not uncommon to encounter subsurface gase pockets whose pressure is much greater than could be resisted by the hydrostatic pressure of the elongated annular column of drilling mud. To prevent the explosive and potentially dangerous and expensive release of gas and/or liquid under pressure upwards out through the drilling hole, blowout preventers are used. Blowout preventers are mounted in a pipe casing surrounding a drill hole, near the upper end of the hole.

Typical blowout preventers have a resilient sealing means which can be caused to tightly grip the outer circumferential surfaces of various diameter drill string components, preventing pressure from subterranean gas pockets from blowing out material along the drill string. Usually, the resilient sealing means of a blowout preventer is so designed as to permit abutting contact of a plurality of sealing elements, when all elements of a drill string are removed from the casing. This permits complete shutoff of the well, even with all drill string elements removed. Most oil well blowout preventers are remotely operable, as, for example, by a hydraulic pressure source near the drill hole opening having pressure lines running down to a hydraulic actuator cylinder in the blowout preventer.

Blowout preventers having resilient sealing means are disclosed in U.S Pat. No. 3,323,773, R. W. Walker, Jun. 6, 1967, and U.S. Pat. No. 3,667,721, issued Jun. 6, 1972 to A. N. Vujasinovic.

Prior blowout preventers, including those disclosed in the above-identified U.S. patents, typically use a circularly spaced array of curved metal segments which are contained slidably in a hemispherical cavity and pushed upwards by a hydraulic piston to effect a reduction in diameter of an upward entrance bore to the spherical cavity, through which drill string components are inserted. The curved metal segments are held in a circumferentially spaced relationship by being molded integrally into a resilient rubber matrix having a generally cylindrical interior shape. When the sealing element comprising the curved metal segments and resilient matrix are moved upwards, the inner cylindrical rubber surface is forced to cold flow inwards towards the outer circumferential surface of the drill stem components within the blowout preventer, thereby effecting a seal and preventing pressurized fluids below the blowout preventer from escaping upwards. In some prior art blowout preventers, sufficient movement of rubber inwards is afforded to completely seal the bore through the blowout preventer, even with all drill string components withdrawn.

Existing blowout preventers can damage drill string components under certain conditions. Since the metal segments used in the sealing element of some blowout preventers is non-resiliently translated longitudinally upward and radially inward by the actuator piston, the upper inner edges of the segments can contact the circumferential surface of drill string components with radial compressive forces sufficient to damage the component. With this and other limitations of prior blowout preventers in mind, the present inventors developed an improved blowout preventer which incorporates force-limiting means for preventing rigid metal segments in the annular sealing element of the blowout preventer from being forced against drill string components sufficiently hard to damage those components. The improved blowout preventer was disclosed in U.S. patent application Ser. No. 054,932 filed 05/27/87 and titled *Blowout Preventer With Radial Force Limiter.* That application resulted in the issuance on Aug. 22, 1989 of U.S. Pat. No. 4,858,882 with the same title.

One embodiment of applicants' above-referenced Blowout Preventer With Radial Force Limiter uses an annular sealing element in which metal sealing elements are moved in front of resilient elastomeric material interposed in the path extending from an actuating piston to the metal sealing elements and thence to the outer cylindrical surface of a drill string component within the bore of the blowout preventer. The compressibility of the resilient material limits the impact force exertable by the rigid sealing elements against the drill string component.

A novel sealing element used in another embodiment of the improved blowout preventer referenced above uses metal sealing segments made of two parts which are moveable with respect to one another. The freedom of one part of a metal sealing segment to move with respect to the other part of the segment limits the force which the metal segments may exert on drill string components as the actuating piston of the blowout preventer moves the sealing element into a closing position.

The present invention was conceived of to provide an improved sealing element for blowout preventers. The improved sealing element includes means for limiting the radial force which the sealing element may exert on a drill string component, and also includes means for compensating for wear of resilient portions of the sealing element, thus maintaining sealing effectiveness for a greater number of operational cycles.

OBJECTS OF THE INVENTION

An object of the present invention is to provide an improved force-limiting sealing element for blowout preventers which has a longer longitudinal sealing contact area.

Another object of the invention is to provide an annular sealing element for blowout preventers which incorporates metal elements in a resilient matrix, and means for compensating for wear of the resilient matrix.

Another object of the invention is to provide an annular sealing element for blowout preventers which is capable of continuously feeding resilient material into a sealing area, even with the blowout preventer in a closed position on an empty bore.

Another object of the invention is to provide an improved annular sealing element blowout preventer which may be retrofittably installed in existing blowout preventers with a minimum of difficulty.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, we do not intend that the scope of our exclusive rights and privileges in the invention be limited to details of the embodiments described. We do intend that equivalents, adaptations and modifications of the invention reasonably inferrable from the description contained herein be included within the scope of the invention as defined by the appended claims.

SUMMARY OF THE INVENTION

Briefly stated, the present invention comprehends an improved annular sealing element for oil well blowout preventers of the type employing an actuating piston to drive a sealing element having metal segments embedded in a resilient matrix upwards and radially inwards within a curved cavity to seal a longitudinal bore through the cavity.

The improved blowout preventer sealing element according to the present invention has a generally circularly symmetric, lenticular-shaped body having a flat base, a convexly curved upper wall surface, and a cylindrical bore of substantial diameter extending coaxially through the body. The sealing element includes a plurality of curved metal segments having in plan view the shape of a sector of a sphere, the vertex of which is truncated by a chordal plane. The upper portion of a segment has a convexly curved outer surface coextensive with upper curved surface of the lenticular body.

The metal segments are imbedded in a resilient matrix of rubber or similar elastomeric material thus forming with the elastomeric material a composite structure. Each of the metal segments comprises a curved tooth-like upper plate section and a vertically oriented supporting web of uniform thickness extending perpendicularly downwards from the mid-point of the plate section. The metal segment includes a base plate having in plan view the shape of a truncated sector of a circle similar to the shape of the upper plate section. The wider, rear part of the base plate, has a slightly convexly curved lower surface. The upper surface of the base plate contains a longitudinally disposed groove for pivotably supporting the lower end of the web. Bosses formed in opposite side walls of the base plate support a cylindrical pivot for the pivotable support of the web.

The narrower, shorter part of the base plate forward of the pivot point has a more generally flat, lower surface, beveled at an upward dihedral angle with respect to the larger, curved lower surface.

The curved lower surfaces of the base plates of the metal segments in the sealing element are adapted to seat on a beveled annular piston ring on the top of annular actuator piston. Upward motion of the piston forces the base plates of the segments upwards. This upward motion in turn forces the upper teeth-like portions of the metal segments, which ride conformally on the curved hemispherical surface of the cavity, upwards and radially inwards to close on the bore within the cavity. Radial upward and inward motion of the tooth-like upper portions of the steel segments forces the resilient portion of the sealing element in which the segments are imbedded to cold flow inwards towards sealing contact with a drill string component in the bore. In the absence of a drill string component within the bore of the cavity, inner diametrically opposed side walls of the resilient portion of the sealing element matrix cold flow inwards into sealing contact with one another, to seal off the bore.

In the novel design of the metal segments of the sealing element according to the present invention, the smaller portion of each segment base plate, forward of the pivot pin, functions as a toe plate, supporting and directing the cold flow of rubber towards the center line of the sealing element bore. This action increases the longitudinal length of the resulting seal, greatly improving the capability of the seal to contain higher pressures than prior art seals. Additionally, the toe portion of the base plate of each steel segment provides a highly effective means of feeding rubber into the seal area, compensating for rubber wear due to the abrading action of drill string components having been pulled through the bore of the sealing element. Thus, the base plate of the novel sealing element according to the present invention serves as a highly effective compensator plate, for compensation for wear of the resilient portion of the sealing element, greatly increasing the effective operational life of the sealing element.

DESCRIPTION OF THE PREFERRED EMBODIMENT

Referring now to FIGS. 1 through 10, an improved annular sealing element for blowout preventers, constructed according to the present invention is shown. The improved annular sealing element according to the present invention is intended for use in blowout preventers of the type using a longitudinally movable actuating piston to drive a sealing element having metal segments embedded in a matrix made of rubber or similar resilient material. In such blowout preventers, upward motion of the actuating piston forces the sealing element upwards and radially inwards within a curved hemispherical cavity within the blowout preventer, causing cold-flow of the resilient matrix into sealing contact with a drill string component within the bore, or upon itself in the absence of a drill string component. The improved annular sealing element according to the present invention includes means for limiting the force which metal segments in the element may exert on a drill string component. Also, the novel annular sealing element according to the present invention includes means for compensating for wear of the resilient matrix.

Figure 1:
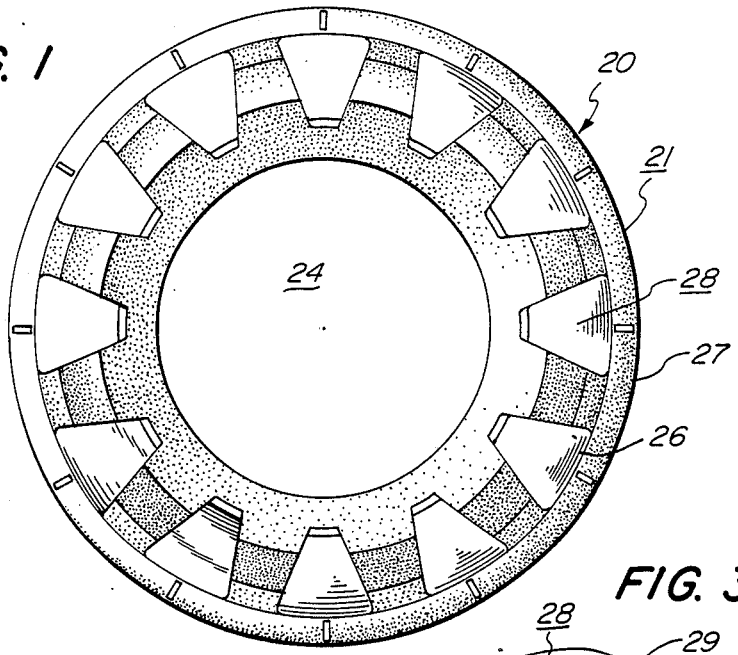
FIG. 1 is an upper plan view of an improved sealing element for blowout preventers according to the present invention.
Figure 2:
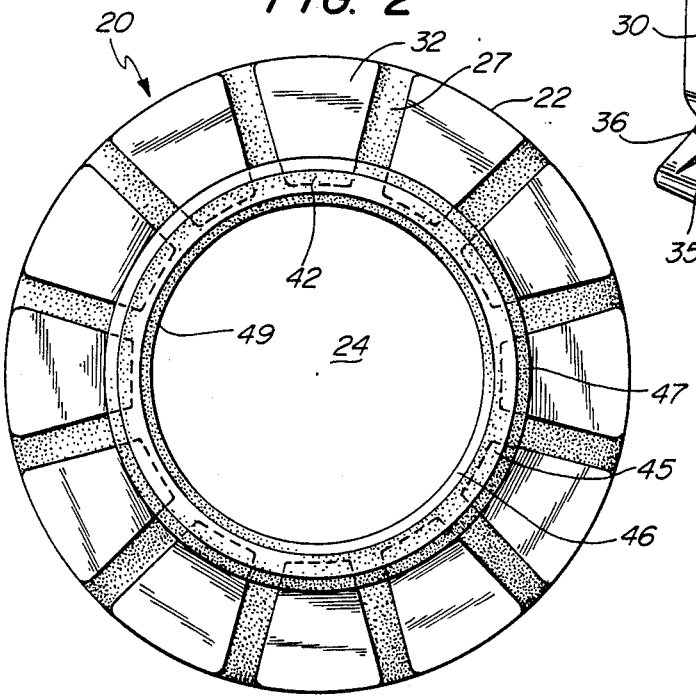
FIG. 2 is a lower plan view of the sealing element of FIG. 1.
Figure 6:
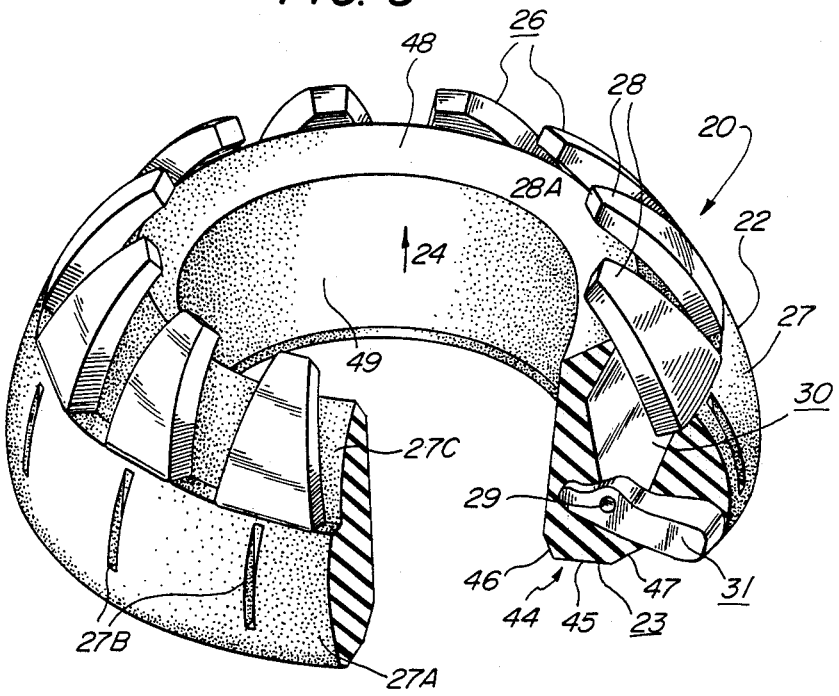
FIG. 6 is a fragmentary perspective view of the sealing element of FIG. 1, with a radial section removed to show the composite structure of the sealing element.

Referring now primarily to FIGS. 1, 2 and 6, the annular sealing element 20 according to the present invention is seen to comprise a circularly symmetric, lenticular-shaped body 21 having convexly curved upper sides 22, a generally flat base surface 23, and a coaxial central bore 24 of substantial diameter relative to the outer diameter of the body, the bore extending completely through the body.

Figure 7:
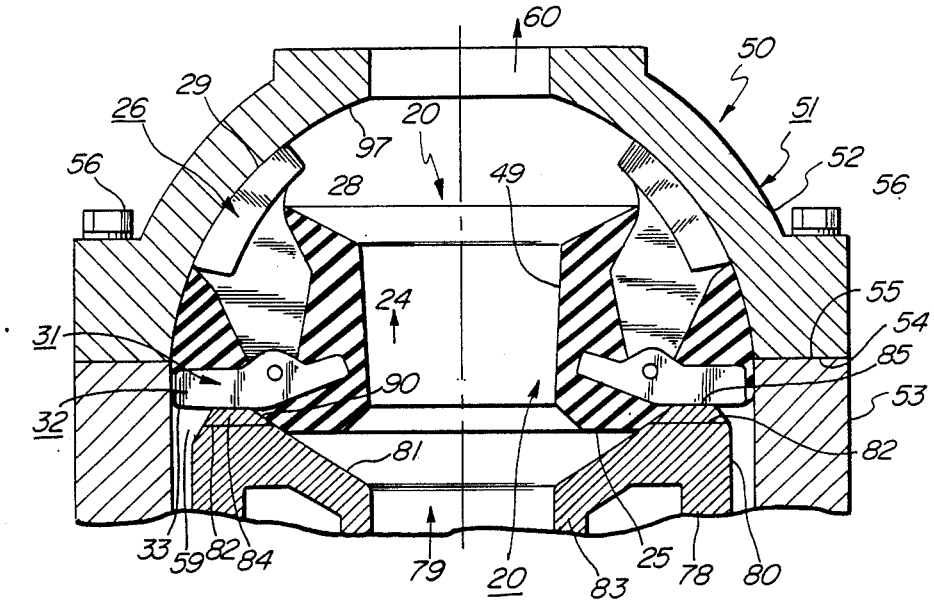
FIG. 7 is a fragmentary longitudinal sectional view of the sealing element of FIG. 1, showing the sealing element installed in a blowout preventer and showing the sealing element in an open position.

As may be seen best by referring to FIG. 7, the annular sealing element 20 is adapted to installation within a blowout preventer 50, in which the housing 51 of the blowout preventer is typically made of an upper section 52 and lower section 53 The upper and lower housing sections 52 and 53 of the housing 51 have a generally circularly symmetric shape, and are sealingly joined to one another along transversely disposed lower and upper annular mating surfaces 54 and 55 respectively, by bolts 56.

The housing 51 of the exemplary blowout preventer 50 of the type in which the annular sealing element 20 is intended to be installed has a generally circularly symmetric hollow interior space 57, formed of a generally hemispheric interior space 58 in upper housing section 52, and a generally annular-shaped interior space 59 in lower housing section 53. A bore 60 in the upper wall 61 of upper housing section 52 is provided to permit communication between the bore of an upper well casing, which may be attached to the blowout preventer, and the hemispherical interior space 58 of the upper housing section. A bore 62 is provided into lower housing section 53. Bore 62 provides communication between the bore of a lower well casing, which may be attached to the blowout preventer, and the hemispherical interior space 58 of upper housing section 52. The outer cylindrical wall surface 65 of boss 64, and the inner cylindrical wall surface 66 of the lower housing section 53, form an annular space 59 in the lower housing section, whose purpose will be described below.

As shown in FIG. 7, the blowout preventer 50 includes a circularly symmetric piston 78 having a hollow central bore 79 and downwardly depending cylindrical walls 80. The upper surface of the piston 78 has a flat annular ring section 82 which extends radially inwards some distance from the outer surface of the cylindrical wall 80. Beginning at the inner edge of the annular ring section 82, the upper surface of the piston 78 slopes downward and inward to the central bore 79 through a downwardly projecting boss 83.

A metal ring 84 having a flat annular lower outermost bottom surface, and a downwardly and inwardly sloping inner bottom surface, is adapted to seat conformally to the upper surface of piston 78. Alternatively, ring 84 can be an integral boss projecting upwards from the upper surface of the piston 78. Preferably, the upper surface 85 of the piston ring 84 slopes downwards and inwards at the same angle as the beveled portion 25 of the bottom wall surface 23 of annular sealing element 20. The piston ring 84 may be attached to the upper surface of piston 78 by any convenient means. For example, such attachment could be made by means of bolts extending downwards through countersunk holes through the upper surface of the piston ring and into threaded holes extending downwards into the flat annular ring section 82 on the top of the piston. When sealing element 20 is installed in blowout preventer 50 on top of a piston cap ring 84 on piston 78, the piston cap ring is constrained to seat in correct position. Therefore, is it not absolutely essential that the piston ring 84 be attached to the piston 78.

Having described how the annular sealing element 20 fits within a blowout preventer 50, details of the novel structure of the sealing element will now be described. Following this, a description of the novel interaction of the sealing element 20 with a blowout preventer 50 is given.

Referring now to FIGS. 1 through 5, it may be seen that the sealing element 20 according to the present invention is a composite structure, containing metal segments 26 integrally molded into a generally cylindrical matrix 27. Matrix 27 is made of a resilient material such as hard rubber or similar elastomer.

Figure 3:
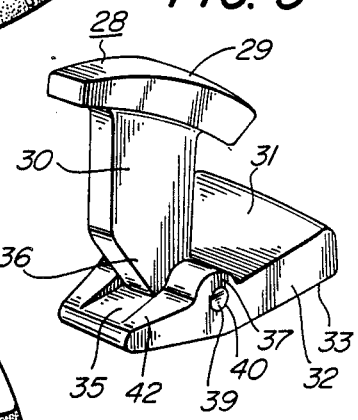
FIG. 3 is an upper perspective view of one of the plurality of identical rigid segments forming part of the sealing element of FIG. 1, showing the upper pivotable portion of the element approximately at the mid-point of its allowable pivotable excursion with respect to the base plate of the rigid segment.
Figure 4:
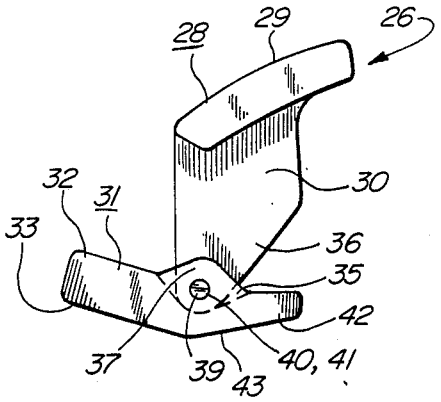
FIG. 4 is a side elevation view of the rigid segment of FIG. 3.
Figure 5:
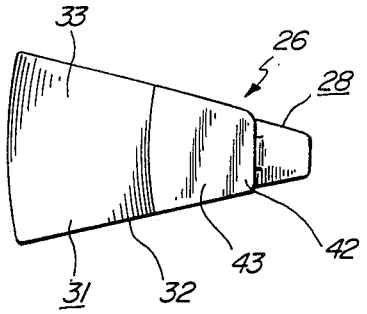
FIG. 5 is a bottom plan view of the rigid segment of FIG. 3, showing the upper pivotable portion of the segment approximately at the forward limit of its allowable pivotable excursion with respect to the base plate of the rigid segment.

As may be seen best by referring to FIGS. 3 through 5, each metal segment 26 has in plan view the shape of a sector of a sphere, the vertex of which section is truncated by a chordal plane. The upper surface of each segment 26 has a convexly curved outer surface 29 which is co-extensive with the upper curved surface of the lenticular body 21.

Each of the metal segments 26 comprises a tooth-like upper plate section 28 having a convexly curved upper outer surface 29. The upper plate section 28 has a vertically oriented supporting web 30 of uniform thickness, which extends perpendicularly downwards from the mid-point of the plate section. Preferably, upper plate section 28 and web 30 are cast in one piece from alloy steel.

Each metal segment 26 includes a base plate 31 having in plan view the shape of a truncated sector of a circle, similar to the shape of the upper tooth-like plate section 28. As may be seen best by referring to FIG. 5, the rear portion 32 of base plate 31 has slightly convexly curved lower surface 33. Surface 33 is convexly curved to provide a sliding surface to ride on piston cap ring 84, as will be described in more detail below.

As may be seen best by referring to FIGS. 3 and 4, the upper surface 34 of the base plate 31 contains a longitudinally disposed groove 35. Groove 35 is provided for pivotably supporting the lower end 36 of web 30. Bosses 37 formed in opposite side walls 38 of the base plate 31 support a cylindrical pivot pin 39 held within holes 40 through the bosses, the pivot pin also passing through a hole 41 in the lower end 36 of web 30.

As shown in FIGS. 3 and 5, base plate 31 of segment 26 includes a wedge-shaped "toe" section 42 which extends forward of the pivot pin 39. The toe section 42 has a lower surface 43 which is more generally flat than the curved lower surface 33 of the rear portion or "heel" 32 of the base plate 31. Lower surface 43 of toe section 42 is beveled at an upward dihedral angle with respect to the curved lower surface 33 of the heel section 32 of the base plate 31.

The purpose of the upward bevel in lower surface 43 of front toe section 42 of base plate 31 is to ensure that an adequate volume of the resilient matrix 27 will be forced into sealing contact with the inner beveled annular surface 81 of piston 78. This will be explained in more detail in conjunction with the discussion of the operation of the invention, with reference to FIG. 8. An important function of the upper surface of the front toe section 42 of compensator base plate 31 is to force and direct the upward and inward cold flow of the resilient matrix into a sealing position, as is explained in detail below.

As may be seen best by referring to FIGS. 1, 2 and 6, each metal segment 26 of sealing element 20 is retained in the molded resilient matrix 27 at equal circumferential angles, equidistant from the longitudinal center line of the bore 24 through the sealing element, thus forming a ring-shaped structure having an upwardly and inwardly curving outer side. The inner portion 27C of resilient matrix 27 has a generally cylindrical shape whose height is less than that of the upper ends of tooth-like plate section 28 of segments 26.

As may be seen best by referring to FIGS. 2 and 6, the entire front toe section 42 of each segment 26 is completely enclosed within the lower portion 27A of the molded matrix 27. Also, a small portion of the heel section 32 of each segment, just rearward of pivot pin 39, is also enclosed within the molded matrix 27.

The lower surface 44 of molded matrix 27 has three different shapes, including a a relatively wide annular center surface 45 which slopes generally upwards and outwards, and serves as a sealing contact surface with piston 78, as will be described below. Lower surface 44 also has an upwardly and inwardly beveled inner annular surface 46, and an upwardly and outwardly beveled outer annular surface 47. The upper annular surface 48 of the resilient matrix 27 is beveled downwards and inwards from the inner, or lower surface of the teeth-like upper plate sections 28 of segments 26, towards the inner cylindrical wall surface 49 encompassing bore 24 of the sealing element 20. As may be seen best by referring to FIG. 6, molded matrix 27 has an outer, lower annular ring-shaped portion 27A which extends upwards from lower surface 44 of the matrix, up to the outer, lower transverse walls of tooth-like upper plate sections 28 of steel segments 26, forming a continuous, smooth convexly curved surface with the outer surfaces 29 of the tooth-like sections. Vertically disposed slots 27B are provided in the outer wall surface of lower ring-shaped portion 27A. Sealing element 20 is manufactured in an inverted position, in which segments 26 are held in place in a mold in which the resilient matrix material 27 is cast around the segments. Slots 27B are provided for lugs within the mold to support segments 26 in their proper position during the molding process. Molded matrix 27A also includes an inner ring-shaped portion 27C, having an upper annular wall surface 48. The height of inner portion 27C is less than that of segments 26, thus positioning surface 48 below the upper edges 28A of tooth-like upper plate sections 28.

OPERATION OF THE INVENTION

Referring now especially to FIGS. 7 through 10, the function of the novel annular sealing element 20 according to the present invention may be described. As shown in FIG. 7, the sealing element 20 is installed in an existing blowout preventer 50 of the type having a generally hemispherically-shaped interior space 58 in the upper housing section 52 of the blowout preventer. In the blowout preventer 50 shown in FIG. 7, an annular ring 84 is shown attached conformally to the flat upper surface 82 of the actuator piston 78 of the blowout preventer. The ring 84 has a flat upper annular surface 85, and an inner beveled wall surface 90 sloping radially inwards and downwards from its inner circumferential boundary. This beveled wall surface 90 is inclined at an angle of approximately 45 degrees with respect to the flat upper annular surface 85 of ring 84. An outer beveled surface 91 extends downwards and radially outwards from upper surface 85 of ring 84, at an angle of approximately 75 degrees. In blowout preventers manufactured originally to utilize the novel sealing element 20 according to the present invention, ring 84 could be formed as an integral part of the upper surface of piston 78.

As shown in FIG. 7, sealing element 20 is so positioned within cavity 58 of blowout preventer 50 so as to place the convexly curved lower base surface 33 of rear heel portion 32 of compensator plate 31 of segments 26 of the sealing element in a generally flat position, seated on top of flat annular surface 85 of ring 84 on top of piston 78. In FIG. 7, the blowout preventer 50 is shown in its fully open position, with piston 78 in its lowermost, retracted state. In this position, the bore 24 through sealing element 20, and also through the blowout preventer, is at is maximum diameter value. With sealing element 20 positioned within the blowout preventer 50 as shown in FIGS. 7 through 10, the convexly curved upper outer surface 29 of the tooth-like upper plate section 28 of each circumferentially spaced-apart steel segment 26 is in slidable tangent contact with the curved inner surface 97 of upper housing section 52.

Figure 8:
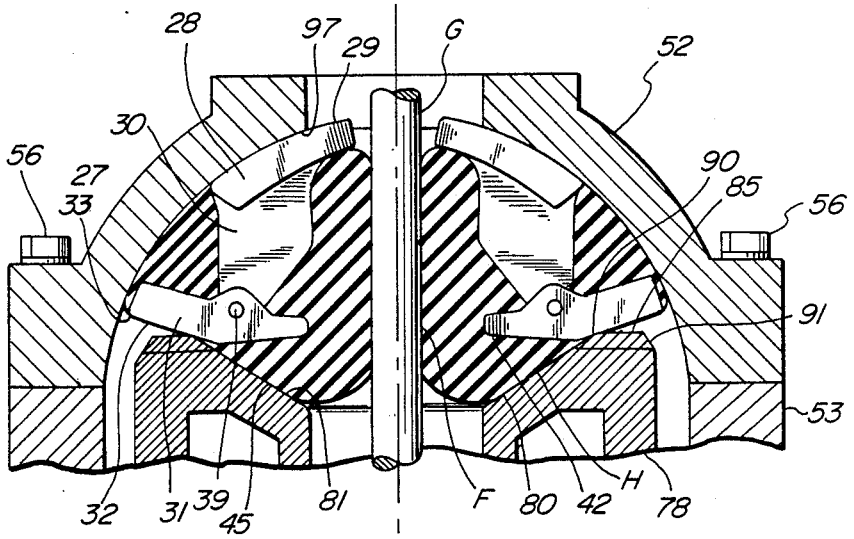
FIG. 8 is a view similar to FIG. 7, but showing the sealing element in sealing peripheral contact with a cylindrical drill string component of relatively small diameter.

To actuate blowout preventer from a fully open position, as shown in FIG. 7, to a closed position, as shown in FIG. 8, hydraulic actuating pressure is used to drive piston 78 upwards. As piston 78 begins to move upwards, the flat, generally horizontal upper surface 85 of piston cap ring 84, which is in abutting contact with the lower surface 33 of the rear heel portion 32 of compensator plate 31 of each segment 26, exerts a generally upward directed, normal force on the heel of the compensator plate. The upward directed normal force exerted on the lower surface 33 of compensator plate 31 is transmitted through pivot pin 39 to web 30 and upper plate section 28 of each segment 26. This force causes the upper, outer surfaces 29 of upper plate sections 28 of the segments 26 to move slidably upwards and radially inwards on the curved surface 97 of the upper housing 52 of the blowout preventer 50. Radially inward motion of the segments 26 forces cold flow of the resilient material of matrix 27, in which the segments are imbedded, radially inwards, thus deforming the inner cylindrical wall surface 49 of the matrix to a smaller diameter.

FIG. 8 shows the sealing element 20 having been moved upwards and radially inwards to form a circumferential sealing contact F with the outer cylindrical surface of a drill string component G, of relatively small diameter. As shown in FIG. 8, the rear heel portion 32 of the compensator base plate 31 of each segment 26 has tilted upwards slightly, seating the convexly curved lower surface 33 of the heel on the intersection between the flat annular upper wall surface 85 of piston cap ring 84 with the beveled inner annular wall surface 90 of the piston cap ring. The curvature of surface 33 permits the two surfaces to slide tangentially with respect to one another, while still allowing a very large normal closing force to be transmitted from the piston cap ring 84 to the heel portion 32 of compensator base plate 31.

As shown in FIG. 8, upward pivotal motion of the rear heel portion 32 of base plate 31 is of course accompanied by downward pivotal motion of the front toe portion 42 of the base plate. The downward motion of the front toe portion 42 of each segment provides a highly effective means for forcing a substantial volume of material of resilient matrix 27 into sealing contact H with beveled annular surface 80 of piston 78. The formation of a seal H of substantial radial extent made possible by the novel design of the annular seal 20 is highly desirable. This is because a seal H of substantial radial extent will inherently withstand higher well-head pressures than a shorter seal. When it is considered that such pressures may be as high as 10,000 psi, the importance of achieving a strong seal can be readily realized.

An additional function of toe portion 42 of compensator plate 31 is to direct the cold flow of resilient material of matrix 27 radially inwards towards the center line of bore 24 of the sealing element 20, thus providing a seal of substantially greater length, and accompanying strength, than prior art sealing elements. It should be noted that the pivotal motion of the upper portion 28 of each segment 26 relative to its base plate 31, in conjunction with the fact that no metal contacts a drill string component G within the bore 24 of the sealing element 20, assures that the force exertable on the drill string component is limited, thus preventing damage to the drill string component.

Figure 9:
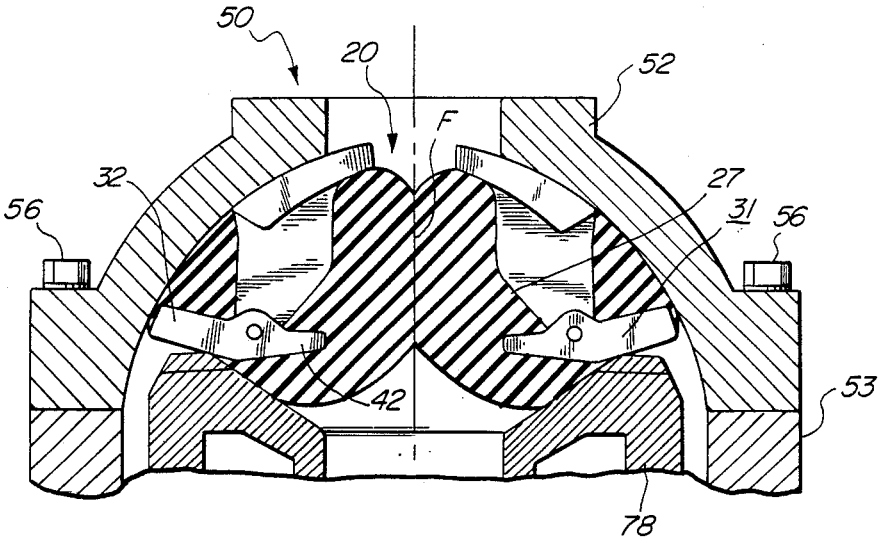
FIG. 9 is a view similar to FIG. 8, but showing diametrically opposed resilient portions of the sealing element in abutting contact, completely sealing off the bore of the blowout preventer device.

FIG. 9 shows the sealing element 20 moved upwards and radially inwards sufficiently far for the bore 24 through the sealing element 20 to be constricted to zero diameter, thus completely sealing the blowout preventer with no drill string component within the bore. Again, the novel design of the sealing element 20, discussed above in conjunction with a description of the sealing action of the sealing element on a drill string component, results in a seal having substantial length, and therefore, great strength.

Figure 10:
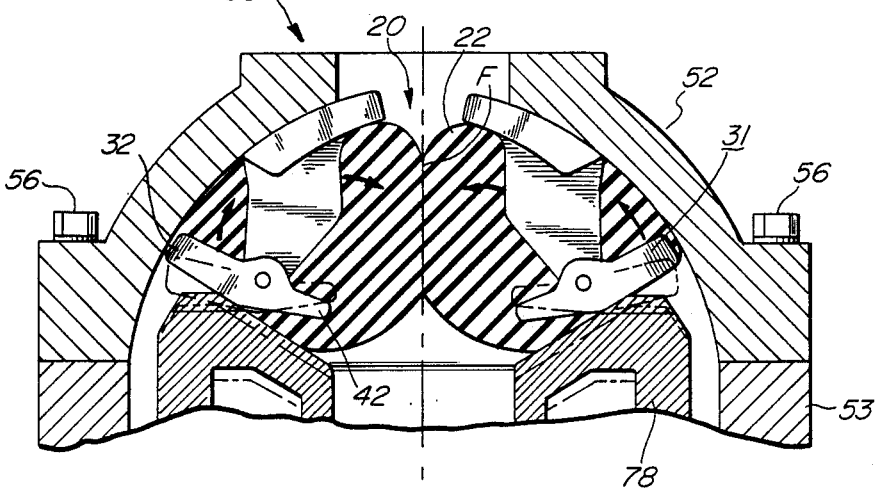
FIG. 10 is a view similar to FIG. 9, but showing how the sealing element compensates for loss of resilient material due to wear.

FIG. 10 illustrates the effectiveness in operation of the sealing element 20 even after a substantial portion of the resilient matrix 27 has been worn away by the continued abrading action on the inner cylindrical wall surface 49 of the matrix, caused by longitudinal motion up and down through the "stripped in" and "stripped out," respectively. As shown in FIG. 10, when resilient material is lost from the matrix 27 for the reasons stated above, the constant upward force exerted by the piston 78 on the rear heel portion 32 of compensator plate 31 feeds new rubber radially upwards and inwards towards the seal area F, as shown by the arrows in FIG. 10.

What is claimed is:

1. An improved annular sealing member for oil well blowout preventers of the type having a housing including an entrance bore, a coaxially aligned exit bore, and a generally circularly symmetric curved hollow interior cavity coaxial with and communicating with said entrance and exit bores, said housing being adapted to receive drill string components coaxially through said entrance and exit bores said housing being adapted to contain a generally lenticular-shaped sealing member having a generally flat lower surface, a convex upper surface, and a hollow central bore, said housing having an actuator piston coaxial with the center line of said housing and movable axially therewithin, said piston having a hollow central coaxial bore and said piston having in its upper face an upper annular area beveled downwards and inwards towards the longitudinal center line of said piston, said upper annular area of said piston being of the proper shape to slidingly engage said lower surface of said sealing member, thereby moving said sealing member longitudinally and radially within said curved hollow interior cavity into sealing circumferential contact with the circumferential surface of said drill string components, or the inner facing radial surfaces of said sealing member; said improved sealing member comprising a generally circularly symmetric lenticular-shaped body having a generally annular-shaped base, a convexly curved upper wall surface, and a cylindrical bore of substantial diameter extending coaxially through the entire body, said body comprising a matrix of resilient material holding a plurality of imbedded metal segments spaced at regular circumferential angles around the bore at equal radial distances therefrom, each of said segments comprising;

a. an upper section with a tooth-like upper plate section having a convexly curved upper, outer surface coextensive with the convexly curved upper, outer wall surface of said lenticular body, said upper plate section having a supporting web extending perpendicularly downwards from the lower surface of said upper plate, centered on the vertical mid-plane of said upper plate, and b. a generally wedge-shaped base plate, said base plate having in plan view the shape of a truncated sector of a circle similar in shape to said upper plate, with a generally straight front, truncated, transverse surface and a generally curved rear transverse face, said base plate having a convexly curved lower surface, and said base plate including pivot means for pivotably supporting the lower end of said web of said upper section, thereby permitting pivotable motion in a vertical plane of said upper section relative to said base plate, said pivot means comprising a horizontally disposed pivot pin attached to said base plate so as to be positioned above the upper surface of said base plate, perpendicular to the longitudinal medial plane of said base plate, said pivot pin passing through the lower end of said web of said upper section of said segment, and said pivot pin being located nearer to the front transverse wall surface of said base plate than to the rear transverse wall surface, thus partitioning said base plate into a relatively short, front toe section and a relatively longer rear heel section.

2. The sealing member of claim 1 wherein the lower surface of approximately the rear half of said base plate is convexly curved, thereby adapting said surface to slide smoothly inwards on the beveled upper annular wall surface of said piston.

3. The sealing member of claim 2 wherein said matrix of resilient material imbedding said segments covers to a substantial thickness the lower surface of approximately the front half of said base plate, and exposes the lower surface of approximately the rear half of said base plate.

4. The sealing member of claim 3 wherein the lower surface of approximately the front half of said base plate is beveled upwards, thereby allowing space for a greater thickness of resilient material between said beveled lower surface and the bottom surface of said sealing element.

5. The sealing element of claim 4 wherein said resilient matrix extends radially inwards beyond said rigid segments, whereby the inner walls of said hollow central bore are comprised entirely of resilient material.

6. The sealing element of claim 5 wherein said resilient matrix is further defined as having a lower circumferential base section in the form of an annular ring having a convexly curved wall surface extending upwards from the base of said lenticular body to the lower transverse wall surfaces of said tooth-like upper plate sections of said segments, the resilient matrix abutting said lower transverse wall surfaces so as to form a continuously circulinear surface with the outer convex surfaces of said tooth-like upper plate sections.

7. The sealing element of claim 6 wherein the inner cylindrical portion of said resilient matrix adjacent the bore of said lenticular body has an altitude less than the altitude of the upper edges of said tooth-like upper plate sections of said segments, thereby exposing said upper edges.

8. The sealing element of claim 7 wherein the bottom annular wall surface of said resilient matrix slopes downwards and inwards towards the central bore of said resilient matrix, thereby adapting said sealing element to form a resilient seal with the downwardly and inwardly beveled upper annular wall surface of said hollow, coaxially aligned piston.

9. An annular sealing element for blowout preventers comprising a generally circularly symmetric lenticular-shaped body having a convexly curved upper wall surface, a generally annularly-shaped base, and a cylindrical bore extending coaxially through the entire height of said body, said body comprising a matrix of resilient material holding a plurality of imbedded metal segments spaced at regular circumferential angles around said bore at equal radial distances therefrom, each of said segments comprising;

a. an upper section with a tooth-like upper plate section having a convexly curved upper, outer surface coextensive with the upper, outer curved surface of said lenticular body, said tooth-like upper plate section having in plan view the shape of a sector of a spheroid, the vertex of said sector truncated by a transverse chordal edge, said upper plate section having a supporting web of generally uniform thickness but decreasing radial width extending perpendicularly downwards from the lower surface of said tooth-like upper plate section, and b. a generally wedge-shaped base plate, said base plate having in plan view the shape of a truncated sector of a circle similar in shape to said upper tooth-like plate section, said base plate having a generally straight, front truncating transverse wall surface and a generally curvilinear rear transverse wall surface co-extensive with the convexly curved outer wall surface of said body, said base plate having a radially disposed groove in its upper wall surface, said groove being adapted to pivotably receive the narrower, lower end of said web, said base plate having formed in opposite side walls thereof a pair of bosss adapted to hold a transversely and horizontally disposed pivot pin for pivotably supporting said lower end of said web, said pivot pin being located nearer to the front transverse wall surface of said base plate than to the rear transverse wall surface, thus partitioning said base plate into a relatively short, front toe section and a relatively longer rear heel section.

10. The sealing element of claim 9 wherein the lower surface of approximately the rear section of said base plate rearward of said pivot pin is convexly curved, thereby adapting said surface to slide smoothly inwards on a beveled upper annular wall surface of a hollow coaxial actuating piston.

11. The sealing element of claim 10 wherein the lower surface of approximately the front section of said base plate forward of said pivot pin is beveled upwards.

12. The sealing element of claim 11 wherein said matrix of resilient material imbedding said segments covers to a substantial thickness the lower beveled surface of said front portion of said base plate, and exposes the lower surface of approximately the rear half of said base plate.

13. The sealing element of claim 12 wherein said resilient matrix radially inwards of said metal segments has the general shape of a cylinder, the upper annular wall surface of which cylinder is lower than the upper ends of said upper tooth-like plate sections, thereby exposing said tooth-like upper plate sections.

* * * * *